US010722410B2

(12) United States Patent
Koh

(10) Patent No.: US 10,722,410 B2
(45) Date of Patent: Jul. 28, 2020

(54) ASSISTANCE CHAIR ASSEMBLY

(71) Applicant: Tuang-Hock Koh, Taichung (TW)

(72) Inventor: Tuang-Hock Koh, Taichung (TW)

( * ) Notice: Subject to any disclaimer, the term of this patent is extended or adjusted under 35 U.S.C. 154(b) by 40 days.

(21) Appl. No.: 16/194,387

(22) Filed: Nov. 18, 2018

(65) Prior Publication Data

US 2020/0155388 A1 May 21, 2020

(51) Int. Cl.
*A61G 5/10* (2006.01)
*A61G 5/12* (2006.01)

(52) U.S. Cl.
CPC ..... *A61G 5/1075* (2013.01); *A61G 5/1094* (2016.11); *A61G 5/121* (2016.11); *A61G 5/125* (2016.11)

(58) Field of Classification Search
CPC .... A61G 5/1075; A61G 5/1056; A61G 5/125; A61G 5/121
USPC ..... 297/325, 311, 313, 316, 317, 318
See application file for complete search history.

(56) References Cited

U.S. PATENT DOCUMENTS 5,729,842 A * 3/1998 McCarthy ..... A61G 5/00 5/83.1
5,996,716 A * 12/1999 Montiglio ..... A61G 5/045 180/6.5
6,068,280 A * 5/2000 Torres ..... A61G 5/045 180/328
6,447,064 B1 * 9/2002 Mundy ..... A61G 5/00 297/313
2002/0185899 A1 * 12/2002 Herman ..... A47C 1/024 297/325
2004/0189071 A1 * 9/2004 Komura ..... A61G 5/14 297/311
2007/0102615 A1 * 5/2007 Engman ..... A61G 5/128 248/371
2013/0127127 A1 * 5/2013 Vainutis ..... A61F 5/3776 280/47.4
2014/0265497 A1 * 9/2014 Hough ..... A61G 5/14 297/316
2016/0073786 A1 * 3/2016 Walker ..... A47C 7/563 297/325

* cited by examiner

*Primary Examiner* — Mark R Wendell

(57) ABSTRACT

An assistance chair assembly includes a base and a chair is positioned on the base. Two upright boards are perpendicularly connected to the top of the base, and two extension portions extend from the rear end of the base. The chair includes two front legs and two rear legs. The front legs each have a curve slots which allows the chair to be is pivotable about the bolts extending through the rear legs of the chair. The weight center of the chair is not moved beyond the two extensions portions of the base when the chair is pivoted toward the two extensions portions.

6 Claims, 7 Drawing Sheets

ASSISTANCE CHAIR ASSEMBLY

BACKGROUND OF THE INVENTION

1. Fields of the Invention

The present invention relates to chair, and more particularly, to an assistance chair assembly that allows the user to lean backward an angle and to maintain the arm rests horizontally.

2. Descriptions of Related Art

A conventional assistance chair assembly for patients of cerebral palsy known to applicant includes a chair, a leg support frame, a foot support board and two foot supports. The leg support frame includes a slide board connected to the chair, and an upright board is vertically connected to the slide board. The slide board horizontally slides relative to the chair. The leg support frame is connected to the foot supports and movable in multiple directions. However, when the chair leans an angle relative to the base of the assistance chair assembly, the weight center is moved to outside of the while assistance chair assembly, and the user may fall backward.

The present invention is intended to provide an assistance chair assembly that is designed to eliminate the drawbacks mentioned above.

SUMMARY OF THE INVENTION

The present invention relates to an assistance chair assembly and comprises a base having a base board and two upright boards are perpendicularly connected to the top of the base board. Two extension portions extend from the rear end of the base board and a recessed area is defined between the two extension portions. Each of the two upright boards has a first hole and a fixing hole. Four wheels are connected to the underside of the base board wherein two of the four wheels are connected to the extension portions. A chair includes a seat board, and two side panels are connected to two sides of the seat board. Each side panel has a side board connected to the inside thereof. A back board is connected between the two side boards. Each side panel has a rear leg and a front leg. Each rear leg has a second hole, and each of the rear legs is connected to the upright board corresponding thereto by extending a bolt through the second hole of the rear leg and the first hole of the upright board. Each front leg has a first curve slot, and a first locking member extends through the first curve slot of the front leg and the fixing hole of the upright board corresponding to the front leg. The chair is pivotable about the bolts while the first locking members is movable within the first curve slots. The weight center of the chair is not located beyond the two extensions portions when the chair is pivoted toward the two extensions portions.

Preferably, two bars are connected between the two upright boards, and the two bars are located above the base board so as to define a room between the two bars, the two upright boards and the base board.

Preferably, a head rest unit is connected to the back board and includes a lift board. The lift board includes an elongate slot defined axially therethrough, and two second locking members extend through the elongate slot and are connected to the back board. When unscrewing the second locking members, the head rest unit is movable along the elongate slot.

Preferably, the chair includes a leg board connected to the underside of the seat board. Two foot boards are connected to the leg board, and two foot supports are connected to the two foot boards respectively.

Preferably, two arm rest units are respectively connected to the two side boards, and each arm rest unit includes a fan-shaped board that is connected to outside of the side board corresponding thereto. An arm rest is connected to the top of the fan-shaped board corresponding thereto. Each fan-shaped board has a second curve slot and a top connection end that is connected to the side board corresponding thereto. A third locking member extends through each of the second curve slots and is connected to the side board corresponding thereto.

Preferably, a table board has two clamp members which detachably clamp the two arm rests to secure the table board on the two arm rests.

Preferably, each of the two rear legs has a notch defined in the rear side thereof. The table board has two lugs, and a restriction slot is formed between each lug and the table board. When the two clamp members are separated from the arm rest, the table board is inserted into the notches, and the inner bottoms of the restriction slots are engaged with the notches.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 4:
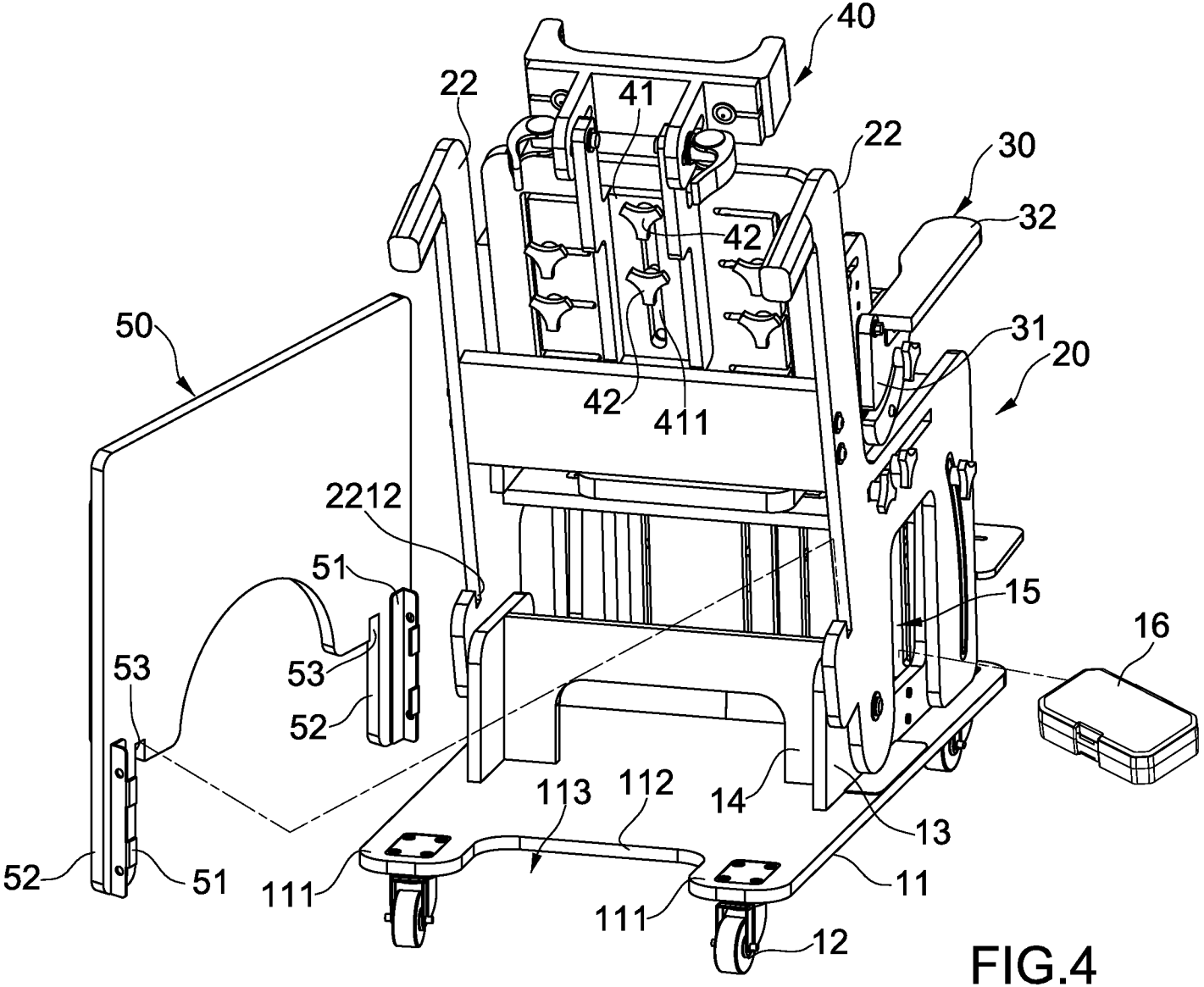
FIG. 4 shows the table board, a tool box and the assistance chair assembly of the present invention.

Referring to FIGS. 1 to 7, the assistance chair assembly of the present invention comprises a base 10 which includes a base board 11, and the base board 11 has a rear end 112, and two extension portions 111 extend from horizontally from the rear end 112. A recessed area 113 is defined between the two extension portions 111. Two upright boards 13 are perpendicularly connected to the top of the base board 11, and each of the two upright boards 13 has a first hole 131 and a fixing hole 132. The first holes 131 is located closer to the rear end 112 than the fixing hole 132. Two bars 14 are connected between the two upright boards 13, and the two bars 14 are located above the base board 11. A room 15 is defined between the two bars 14, the two upright boards 13 and the base board 11. The room 15 is designed to store a tool box 16 of the like as shown in FIG. 4. Four wheels 12 are connected to the underside of the base board 11 and two of the four wheels 12 are connected to the extension portions 111 so as to support the rear end 112 of the base board 111.

Figure 6:
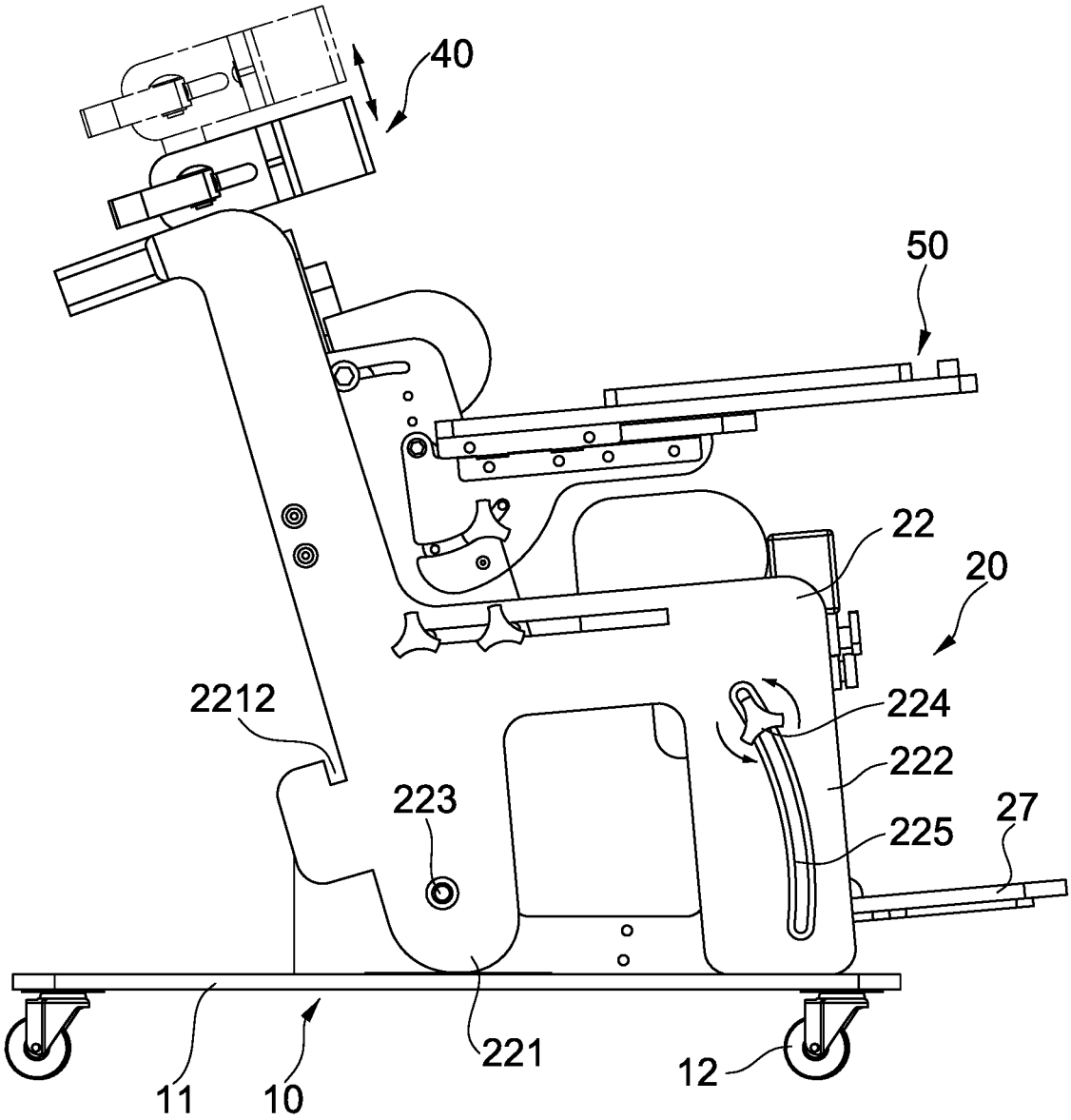
FIG. 6 is a side view to show the assistance chair assembly of the present invention.
Figure 7:
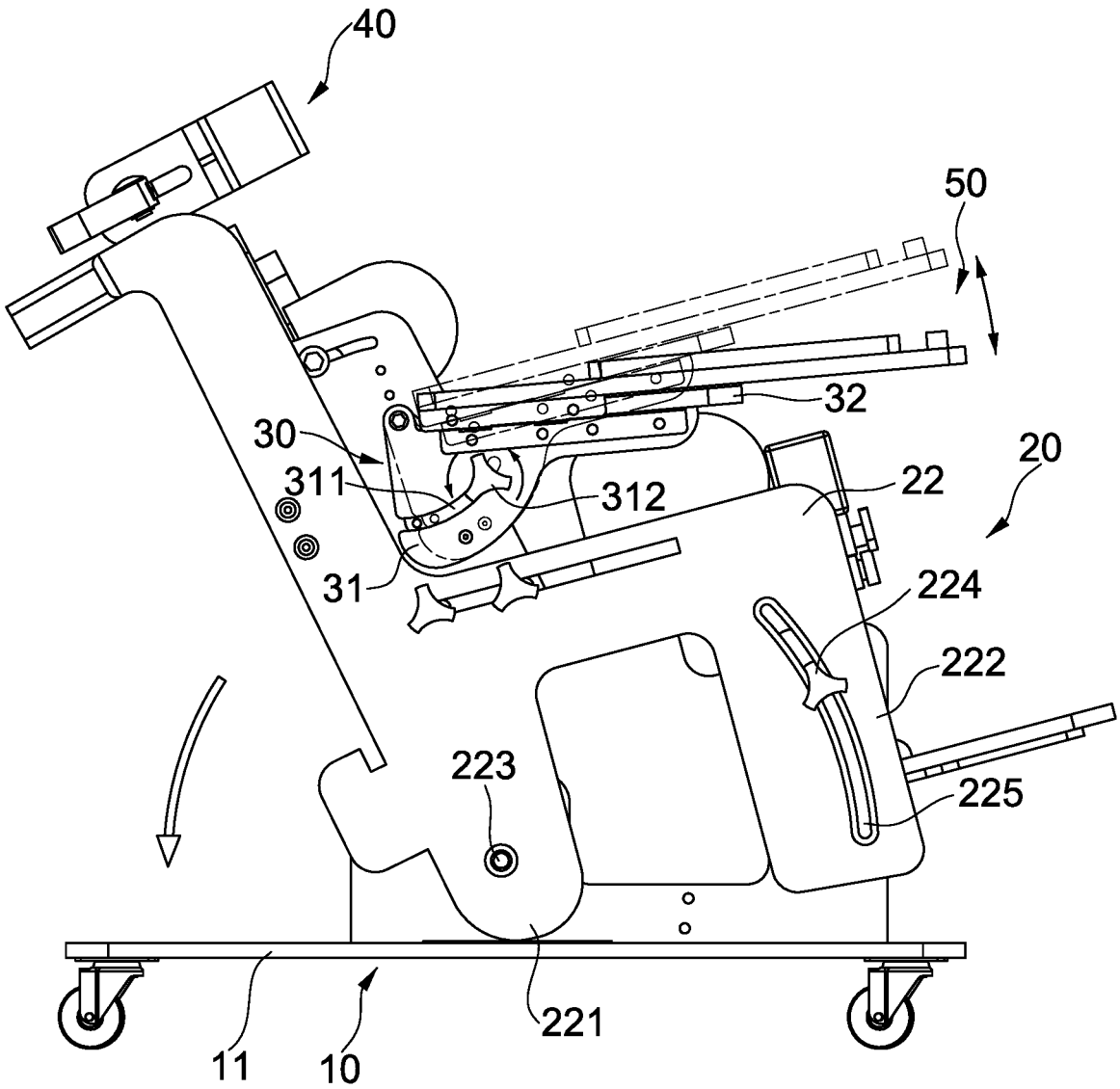
FIG. 7 shows that the chair is pivoted toward the two extension portions.

A chair 20 includes a seat board 21, and two side panels 22 are connected to two sides of the seat board 21. Each side panel 22 has a side board 23 connected to the inside thereof. The side boards 23 are located above the seat board 21. A back board 24 is connected between the two side boards 23. Each side panel 22 has a rear leg 221 and a front leg 222, each rear leg 221 has a second hole 2211 and is connected to the upright board 13 corresponding thereto by extending a bolt 223 through the second hole 2211 of the rear leg 221 and the first hole 131 of the upright board 13. Each front leg 222 has a first curve slot 225, and a first locking member 224 extends through the first curve slot 225 of the front leg 222 and the fixing hole 132 of the upright board 13 corresponding to the front leg 22. Therefore, when the first locking members 224 are unscrewed, the chair 20 is pivotable about the bolts 223 while the first locking members 224 movable within the first curve slots 225. As shown in FIGS. 6 and 7, the weight center of the chair 20 is not moved beyond the two extensions portions 111 when the chair 20 is pivoted toward the two extensions portions 111, so that the assistance chair assembly does not fall backward.

The chair 20 includes a leg board 25 connected to the underside of the seat board 21. Two foot boards 26 are connected to the leg board 25, and two foot supports 27 are connected to the two foot boards 26 respectively.

Figure 1:
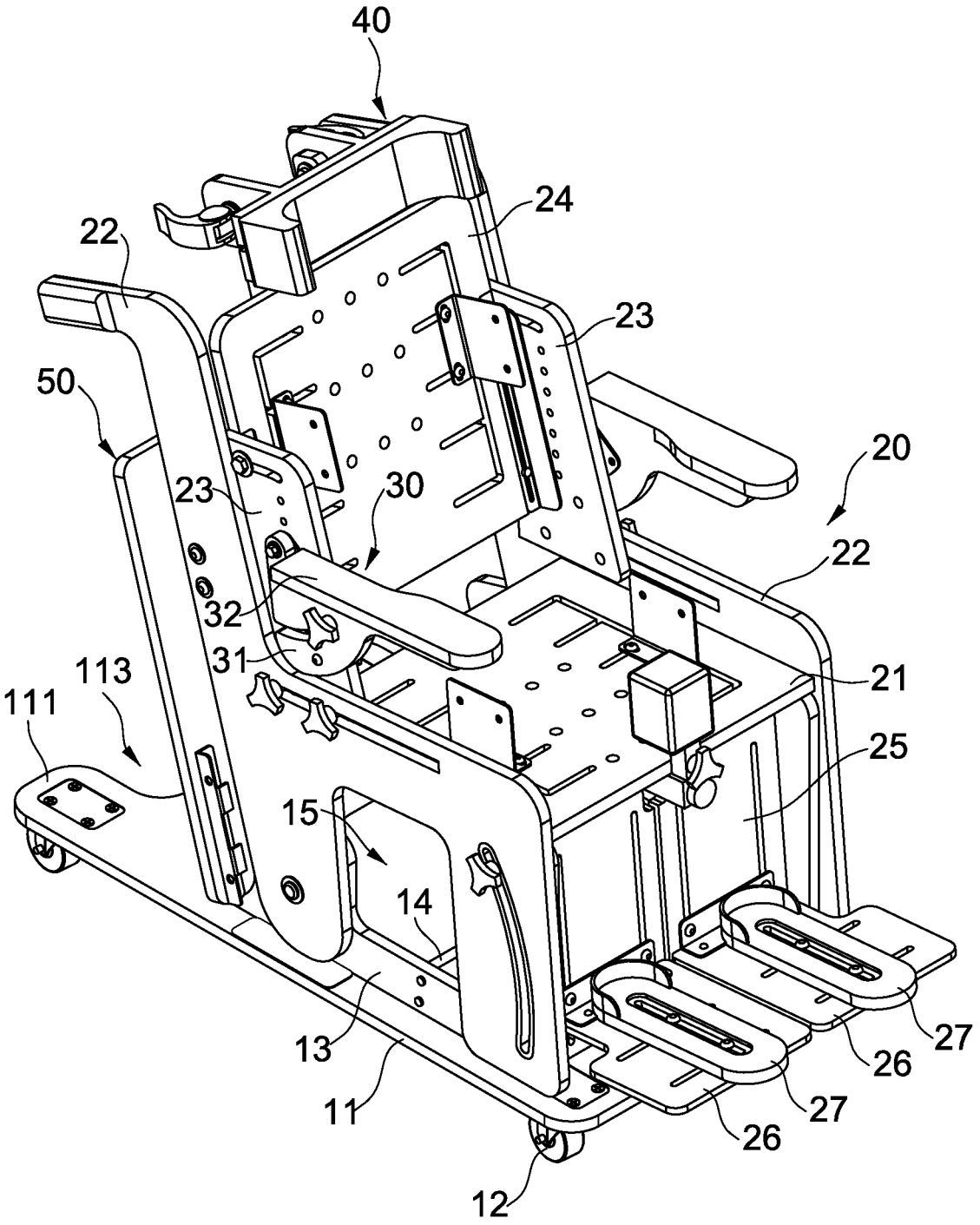
FIG. 1 is a perspective view to show the assistance chair assembly of the present invention.
Figure 2:
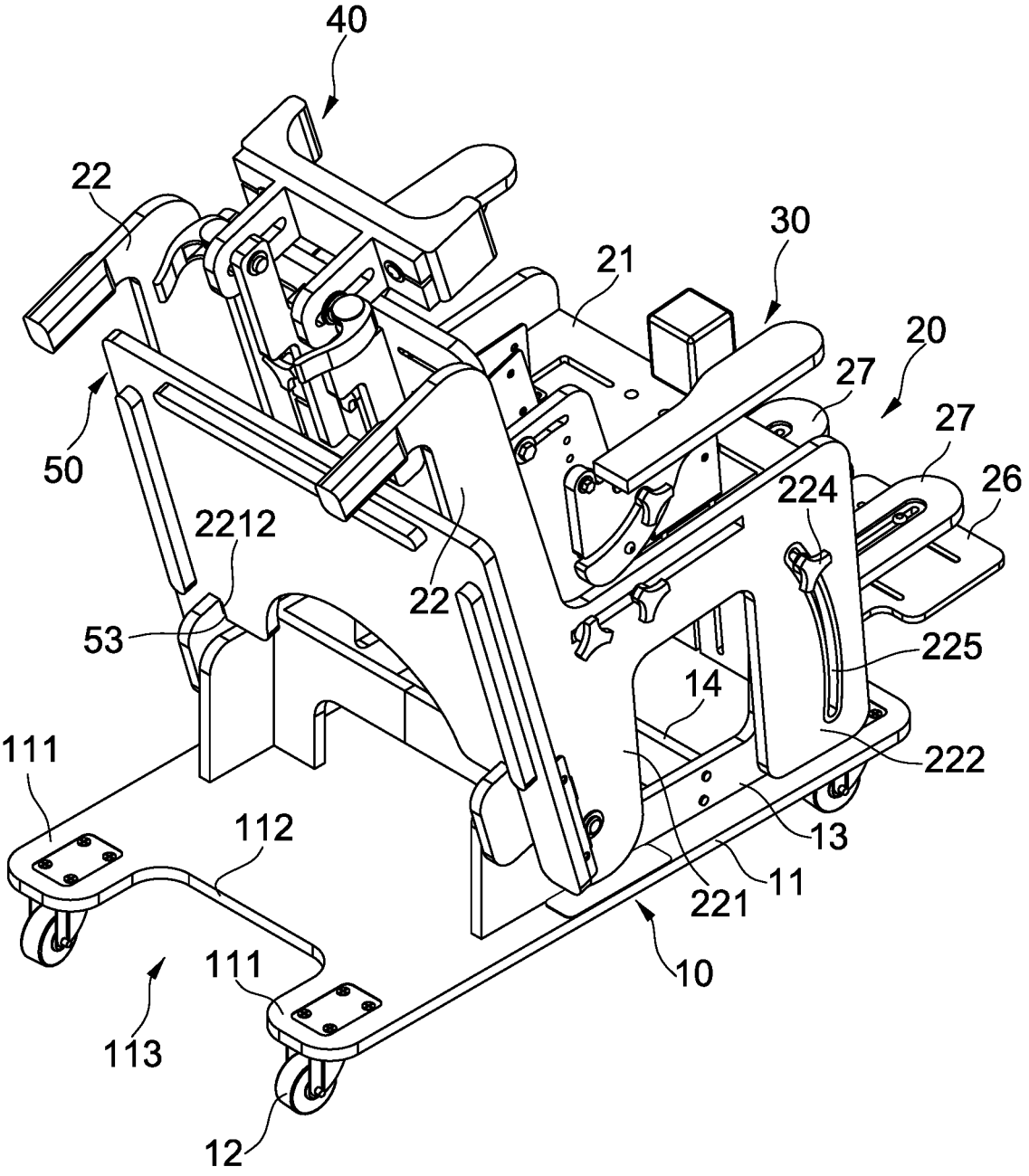
FIG. 2 is a rear perspective view to show the assistance chair assembly of the present invention.
Figure 3:
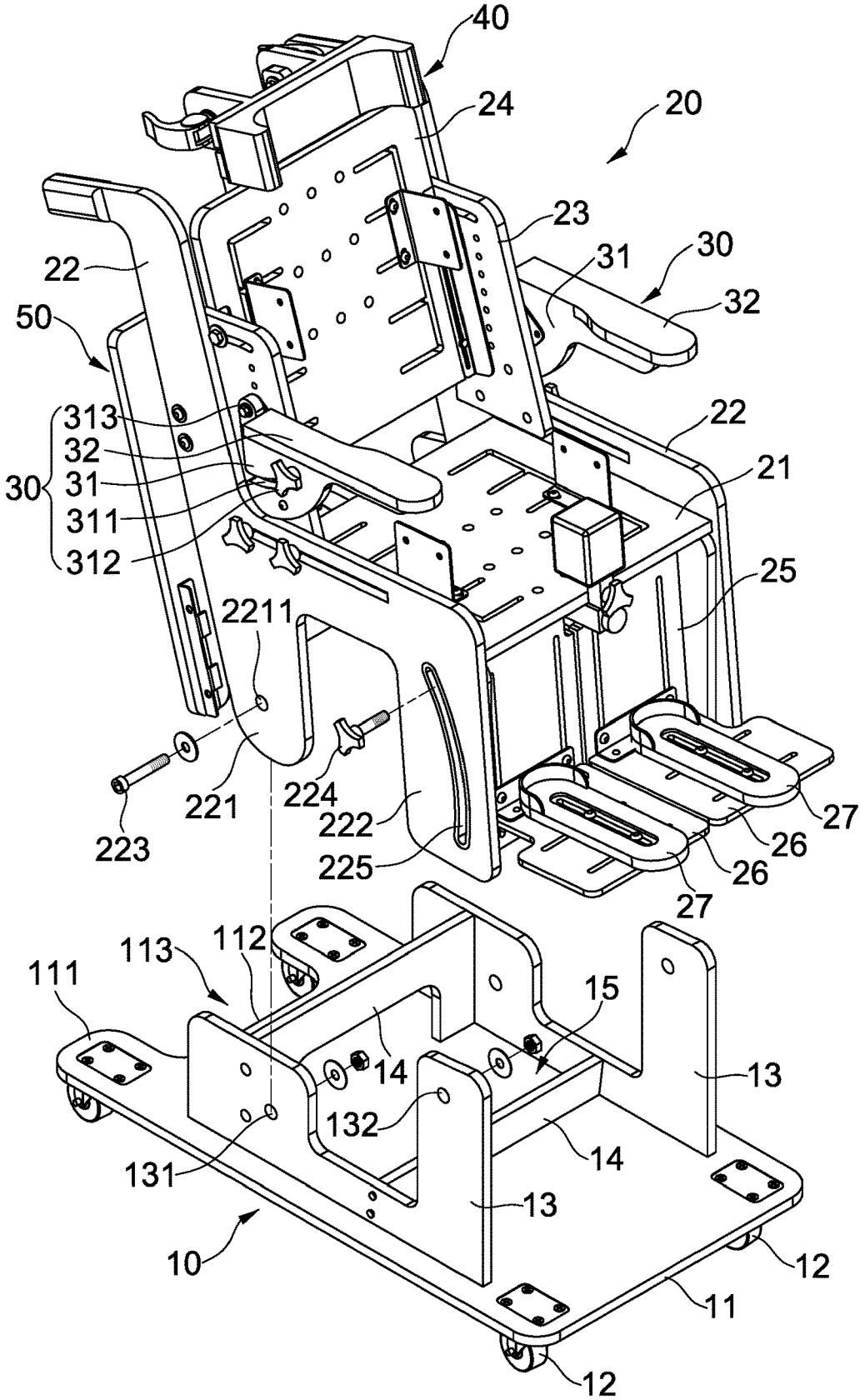
FIG. 3 is an exploded view of the assistance chair assembly of the present invention.
Figure 5:
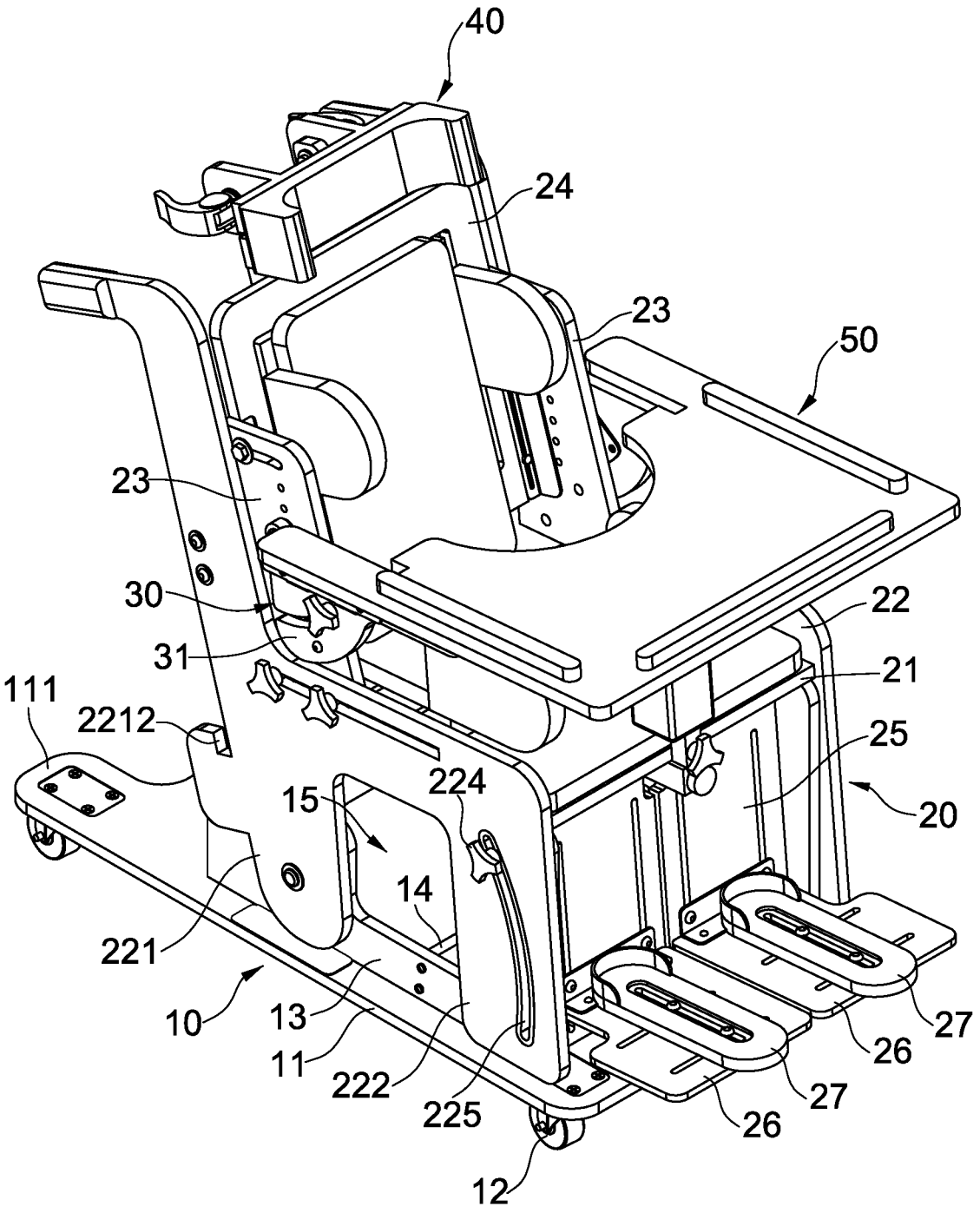
FIG. 5 shows that the table boards is positioned on the two arm rests.

As shown in FIGS. 4 to 7, two arm rest units 30 are respectively connected to the two side boards 23. Each arm rest unit 30 includes a fan-shaped board 31 that is connected to outside of the side board 23 corresponding thereto. An arm rest 32 is connected to the top of the fan-shaped board 31 corresponding thereto. Each fan-shaped board 31 has a second curve slot 311 and a top connection end 313 that is connected to the side board 23 corresponding thereto. A third locking member 312 extends through each of the second curve slots 311 and is connected to the side board 23 corresponding thereto. Each third locking member 312 has a first end thereof contacting against the fan-shaped board 31, and a second end of each third locking member 312 contacts the side board 23. Furthermore, the assistance chair assembly includes a table board 50 which has two clamp members 51 so as to detachably clamp the two arm rests 32 to secure the table board 50 on the two arm rests 32 as shown in FIG. 5. Each of the two rear legs 221 has a notch 2212 defined in the rear side thereof. The table board 50 has two lugs 52, and a restriction slot 53 is formed between each lug 52 and the table board 50. When the table board 50 is not in use, the two clamp members 51 are separated from the arm rest 32, so that the table board 50 is brought to the rear end 112 of the base board 11 and inserted into the notches 221, and inner bottoms of the restriction slots 53 are engaged with the notches 2212 as shown in FIG. 2. As shown in FIG. 7, when rotating the third locking members 312 along the direction shown by the arrow head, the two fan-shaped boards 31 are released, and the two fan-shaped boards 31 are pivoted about the top connection ends 313 such that the arm rests 32 can be maintained horizontally when the chair 20 is pivoted backward.

As shown in FIG. 4, a head rest unit 40 is connected to the back board 24 and includes a lift board 41. The lift board 41 includes an elongate slot 411 defined axially therethrough. Two second locking members 42 extend through the elongate slot 411 and are connected to the back board 24. The two second locking members 42 each have a first end contacting against the back board 24, and a second end of each second locking member 42 contacts the lift board 41. When unscrewing the second locking members 42, the head rest unit 40 is movable along the elongate slot 411 to adjust the height of the head rest unit 40 as shown in FIG. 6.

The advantages of the present invention are that the chair 20 does not fall backward because the weight center is not moved beyond the two extension portions 111. Each extension portion 111 has a wheel 12 connected thereto so as to ensure that the chair 20 stably. The recessed area 113 provides a space for the person who helps to operate the assistance chair assembly. Besides, the arm rests 32 can be maintained in horizontal direction even when the chair 20 is pivoted backward so that the table board 50 is also kept in horizontal direction.

While we have shown and described the embodiment in accordance with the present invention, it should be clear to those skilled in the art that further embodiments may be made without departing from the scope of the present invention.

What is claimed is:

1. An assistance chair assembly comprising:

a base having a base board and two upright boards which are perpendicularly connected to a top of the base board, the base board having a rear end and two extension portions extending from the rear end, a recessed area defined between the two extension portions, each of the two upright boards having a first hole and a fixing hole, the first holes located closer to the rear end than the fixing hole, four wheels connected to an underside of the base board and two of the four wheels connected to the extension portions;

a chair having a seat board, two side panels connected to two sides of the seat board, each side panel having a side board connected to an inside thereof, the side boards located above the seat board, a back board connected between the two side boards, each side panel having a rear leg and a front leg, each rear leg having a second hole, each of the rear legs connected to the upright board corresponding thereto by extending a bolt through the second hole of the rear leg and the first hole of the upright board, each front leg having a first curve slot, a first locking member extending through the first curve slot of the front leg and the fixing hole of the upright board corresponding, to the front leg, the chair being pivotable about the bolts white the first locking members movable within the first curve slots, a weight center of the chair being not located beyond the two extensions portions when the chair is pivoted toward the two extensions portions, and a head rest unit connected to the back board and including a lift board, the lift board including an elongate slot defined axially therethrough, two second locking members extending through the elongate slot and connected to the back board, the two second locking members each having a first end contacting against the back board, a second end of each second locking member contacting the lift board, when unscrewing the second locking members, the head rest unit is movable along the elongate slot.

2. The assistance chair assembly as claimed in claim 1, wherein two bars are connected between the two upright boards, the two bars are located above the base board, a room is defined between the two bars., the two upright boards and the base board.

3. The assistance chair assembly as claimed in claim 1, wherein the chair includes a leg board connected to an underside of the seat board, two foot boards are connected to the leg board, two foot supports are connected to the two foot boards respectively.

4. The assistance chair assembly as claimed in claim 1., wherein two arm rest units are respectively connected to the two side boards, each arm rest unit includes a fan-shaped board that is connected to outside of the side board corresponding thereto, an arm rest is connected to a top of the fan-shaped board corresponding thereto, each fan-shaped board has a second curve slot and a top connection end that is connected to the side board corresponding thereto, a third locking member extends through each of the second curve slots and is connected to the side board corresponding thereto, each third locking member has a first end thereof contacting against the fan-shaped board, a second end of each third locking member contacts the side board.

5. The assistance chair assembly as claimed in claim 4, wherein a table board has two clamp members which detachably clamp the two arm rests to secure the table board on the two arm rests.

6. The assistance chair assembly as claimed in claim 5, wherein each of the two rear legs has a notch defined in; rear; rear side thereof, the table board has two lugs, a restriction slot is formed between each lug and the table board, when the two clamp members are separated from the arm rest, the table board is inserted into the notches, and inner bottoms of the restriction slots are engaged with the notches.

* * * * *